US005504120A

United States Patent [19]

Hopkins, Jr. et al.

[11] Patent Number: 5,504,120

[45] Date of Patent: Apr. 2, 1996

[54] RECYCLING CELLULOSE ESTERS FROM THE WASTE FROM CIGARETTE MANUFACTURE

[75] Inventors: John B. Hopkins, Jr., Pineville; Howard T. Bradsher; David O. Kutscher, both of Charlotte, all of N.C.

[73] Assignee: Hoechst Celanese Corporation, Somerville, N.J.

[21] Appl. No.: 345,273

[22] Filed: Nov. 28, 1994

Related U.S. Application Data

[63] Continuation-in-part of Ser. No. 209,965, Mar. 18, 1994, abandoned.

[51] Int. Cl.[6] ..... C08J 11/00

[52] U.S. Cl. ..... 521/40; 521/48; 131/96

[58] Field of Search ..... 131/96; 521/40, 521/48

[56] References Cited

U.S. PATENT DOCUMENTS

| | | | |
|---|---|---|---|
| 2,264,828 | 12/1941 | Crum | 536/76 |
| 2,860,132 | 11/1958 | White et al. | 536/76 |
| 3,012,914 | 12/1961 | Battista et al. | 131/17 |
| 3,224,451 | 12/1965 | Dearsley | 131/20 |
| 4,191,199 | 3/1980 | Sullivan | 131/96 |
| 4,261,790 | 4/1981 | Brinker et al. | 156/584 |
| 4,298,013 | 11/1981 | Semp et al. | 131/308 |

*Primary Examiner*—Jeffrey Mullis
*Attorney, Agent, or Firm*—R. H. Hammer, III

[57] ABSTRACT

A process for recycling waste from the manufacture of filtered cigarettes is disclosed herein. The process comprises the following steps: A waste stream from the manufacture of filtered cigarettes is provided. The waste stream includes tobacco, filter tips comprising cellulose ester polymer, and paper. A substantial portion of the filter tips is separated from this waste stream. The filter tips are washed with a sufficient volume of water to liberate bound tipping paper and to remove contaminants from the cellulose ester polymer. Oxidizers may be added to improve tip color and/or serve as a pretreatment. The cellulose ester polymer may then be dried, resolutioned, and processed into useful articles of commerce.

12 Claims, No Drawings

RECYCLING CELLULOSE ESTERS FROM THE WASTE FROM CIGARETTE MANUFACTURE

This is a continuation-in-part of Ser. No. 08/209,965, filed 18 Mar. 1994, now abandoned.

FIELD OF THE INVENTION

This invention is directed to recycling waste, particularly cellulose esters, generated during the manufacture of filtered cigarettes.

BACKGROUND OF THE INVENTION

Fibrous cellulose esters, particularly cellulose acetate, are the commercially preferred media for filtration of smoke from filtered cigarettes. This commercial application consumes worldwide several hundred million pounds of cellulose acetate fiber per year. During the production of these filtered cigarettes, a certain percentage of them will not be brought to market, due to damage of goods, variation from specification, or other reasons. Those cigarette which are not sold are typically subjected to a reclamation process wherein the tobacco-laden portion of the cigarette is mechanically broken from the filter, and the tobacco is removed by shaking within a screening device. An example of this process is given in U.S. Pat. No. 3,224,451, which is incorporated herein by reference. After reclamation of tobacco, several tens of millions of pounds of residual material, referred to as "ripper waste" in the industry, comprised of cellulose acetate (typically plasticized for example with glycerol triacetate), paper, residual tobacco, and often flavors and fragrances remain; this ripper waste is most generally disposed of as landfill, representing both a loss of natural resources and a burden on landfill capacity.

The composition of ripper waste varies depending on the specifics of the cigarette products and the tobacco reclamation process employed. Typical composition ranges, by weight, of ripper waste are: a) cellulose acetate, 40–55%; b) plasticizer, 1–12%; c) paper, 25–45%; d) residual tobacco, 1–15%; e) adhesives, 2–3%; and f) flavors/fragrances, <1% Additional components, for example charcoal, may be found in these waste streams, depending on the specific cigarette product.

The physical/mechanical separations employed in reclaiming cigarette components have in the past either focused on sifting tobacco away from other components, as is the case in U.S. Pat. No. 3,224,451, or in the removal of cellulose acetate filter media from its paper liner, as in U.S. Pat. No. 4,261,790, which is incorporated herein by reference. Other approaches have included enzymatic degradation of the cellulose acetate to produce useful sugars, as in U.S. Pat. No. 4,298,013.

Isolation of cellulose acetate from ripper waste is insufficient to provide a recycled product of high commercial utility. During the manufacture of cigarettes, the cellulose acetate is treated with a plasticizer which improves the mechanical performance of the finished filter. The cellulose acetate may also be treated with flavorants, for example, menthol, and the cellulose acetate will absorb some levels of nicotine and other substances from the tobacco. If the cellulose acetate/plasticizer/flavors mixture is dissolved in a typical cellulose ester solvent, and reformed into a product, these extraneous substances will change both the mechanical and the sensory properties of the cellulose acetate, thereby reducing the overall quality of products manufactured with these recycled materials. Extraction with conventional solvents, such as ethanol, can be used to remove the majority of undesirable contaminants from cellulose acetate. But, the extraction solvents then become an undesirable contaminant, and reduce the product quality. An additional difficulty introduced by use of such extraction solvents is that they can escape into the environment, necessitating costly preventative measures.

The difficulties attendant in the use of conventional organic extractions can be avoided by use of a supercritical or near supercritical fluid extraction as in U.S. patent application Ser. No. 07/967,088 filed Oct. 27, 1992, which is incorporated herein by reference. In such a critical or near supercritical extraction process, a material which is gaseous under normal atmospheric temperatures and pressures, for example carbon dioxide, is converted into a high pressure solvent. This high pressure solvent can effectively dissolve the contaminants present in the filter tip waste, liberating these organic contaminants when the fluid's pressure and temperature are reduced. The extraction fluid used in this supercritical or near supercritical process can be effectively recycled within the process, and does not leave a residue within the recycled cellulose ester polymer product. While this high pressure process can effectively cleanse filter tip waste of it unwanted organic contaminants, it does require a significant capital investment for the construction of equipment vessels capable of safe operation under the relatively high pressures required to enter the supercritical or near supercritical region of most desirable fluids.

In U.S. Pat. No. 4,191,199, water is used to soften the glue seams in whole cigarettes. Once the tobacco column, that portion of the cigarette which actually contains the tobacco, has been opened, then free tobacco can be mechanically removed by traditional routes.

Water wash steps used in the manufacture of virgin cellulose ester polymer are well known to those skilled in the art. Such washing removes manufacturing residues such as long chain fatty acids, and acetic acid from the cellulose ester polymer. Such water washing of virgin cellulose ester polymers is described in U.S. Pat. Nos. 2,264,828, 2,860,132, and "Cellulose Acetate", *Kirk-Othmer Encyclopedia of Chemical Technology, 3rd Edition,* John Wiley and Sons, New York.

Another application of water processing in the reclamation of cigarette waste is the reconstitution of small particles of tobacco, fines, recovered through traditional shaking/screening processes into a tobacco sheet or paper. An example of such a reconstitution process is given in U.S. Pat. No. 3,012,914.

The technical literature contains a great many references to the wet pulping of cellulose. Those familiar with the chemistry, binding properties, and solution properties of both cellulose acetate and cellulose will recognize that these two polymers share few common properties, and, therefore, must be treated as different materials. See, "Cellulose" and "Cellulose Acetate", *Kirk-Othmer Encyclopedia of Chemical Technology, 3rd Edition,* John Wiley and Sons, New York.

SUMMARY OF THE INVENTION

A process for recycling waste from the manufacture of filtered cigarettes is disclosed herein. The process comprises the following steps: A waste stream from the manufacture of filtered cigarettes is provided. The waste stream includes tobacco, filter tips comprising cellulose ester polymer, and paper. A substantial portion of the filter tips is separated from this waste stream. The filter tips are washed with a sufficient volume of water to liberate bound tipping paper and to remove contaminants from the cellulose ester polymer. The cellulose ester polymer may then be dried, resolutioned, and processed into useful articles of commerce.

DESCRIPTION OF THE INVENTION

The present invention, which is directed to a process for recycling the waste from the manufacture of filtered cigarettes, is set forth in greater detail below.

The waste stream from the manufacture of filtered cigarettes comprises generally tobacco, paper, and cellulose ester filter material. This waste stream may be ripper waste, as discussed above, or may be the entire broken filtered cigarettes (the differences between the latter and the former being that the latter would have a greater tobacco content). The cellulose ester filter material typically comprises a fibrous form of cellulose acetate, which is referred to in the industry as "TOW", and various contaminants, discussed below.

The cellulose ester filter material or polymer generally comprises cellulose acetate (acetyl value of ranging from about 38% to about 41%), but may also include other conventionally known or commercially available cellulose esters. The cellulose acetate filters are typically contaminated with plasticizers, adhesives, and flavors/fragrance during the manufacture of both the filter tips and of the filtered cigarettes. Examples of plasticizers include, but are not limited to, triacetin (also known as glycerol triacetate, or PZ), trimethylene glycol diacetate (also known as TEGDA), and mixtures thereof. Examples of adhesives used in the manufacture of cigarettes include, but are not limited to, polyvinyl acetate (PVA), ethylene vinyl acetate (EVA), cellulose acetate, and mixtures thereof. The flavors/fragrances may be absorbed by the filter material from the tobacco, for example, nicotine, or may be added, for example, menthol.

Preferably, before the contaminants are removed from cellulose ester polymer, the cellulose ester polymer is removed from the waste stream. The weight content of tobacco in the cellulose ester polymer, after the separation, should be less than about 1% by weight.

Any conventional means may be used for separating the cellulose ester polymer from the waste stream. Examples of such methods include: manually separating tobacco and paper from the cellulose ester polymer; screening or sifting paper and tobacco from the cellulose ester polymer; and cycloning or elutriating the paper and tobacco from the cellulose ester polymer. Elutriation by air is the preferred method for separating the cellulose ester polymer from the waste stream.

Optionally, the waste stream, either before or after the foregoing separation, may be subjected to any conventional particle size reduction process. These particle size reduction processes facilitate separation as is known to those of ordinary skill in the art. Such processes include, but are not limited to, grinding, chopping, milling, and pelletizing.

Once the loose paper and tobacco materials have been separated from the cellulose ester filter tips, two additional separations are required to ultimately produce recycled cellulose acetate free or substantially free of contaminants. The cellulose ester filter material will generally be encased, or wrapped in a paper plug wrap (or tipping paper), which is generally glued to itself or to the filter. Removal of this bound paper will be necessary to insure both the purity and the filterability of solutions of the recycled cellulose ester. The cellulose ester filter material will also be generally contaminated by the tobacco flavorants/fragrances, adhesives, and plasticizers detailed above.

The removal of the tipping paper and of the contaminants contained in the cellulose ester filter material is accomplished in this invention, by a water washing process. The combination of water and heat can result in the nearly complete removal of tipping paper from the cellulose ester. The same washing process, under the proper conditions, can result in the complete removal of plasticizers, adhesives, and flavors/fragrances within the limits of detection of analytical instruments routinely employed for chemical analyses.

The water used in the washing process maybe between about 10 and about 100 degrees centigrade in temperature. The pH of the water maybe between 4.0 and 8.0. A water to cellulose ester ratio of about 0.85 to 200:1 maybe employed. The addition of low levels (less than about 1% by weight) of surfactants maybe employed to improve the efficiency of the washing process. Alternatively, steam, generally below 100 psig in pressure, maybe used in lieu of water, or in addition to water in the washing process of this invention. Oxidizers such as peroxide or bleaches may be added to improve tip color and/or serve as a pretreatment to accelerate the breakage of the paper's hydrogen bonding, thus making the paper removal easier during the hot water wash process step.

The washing process maybe accomplished using any suitable device or container. These devices include, but are not limited to, static baskets, rotary baskets, rotary tumblers, and screw or auger driven continuous washers. Such washing devices are commercially available, and will be well known to those skilled in the art.

The conditions used during the washing process maybe constant throughout the process, or maybe varied by stages or cycles. Use of stages or cycles to vary conditions maybe used to optimize the washing efficiency, while minimizing the consumption of energy and water.

In a preferred embodiment, cellulose ester polymer is washed with liquid water held between 15 and 55 degrees C. in a multiple stage process.

Once washed, and free of contaminants, the cellulose ester polymer may be dried using any commercially available drier suited for such polymers. Such equipment, and the processes for their operation, are well known to those skilled in the art.

The water washing process of this invention produces cellulose ester polymer of sufficiently good quality that it can be resolvated, filtered, and used as virgin polymer or with virgin polymer. However, if necessary, this recycled polymer could be subjected to further separation if residual tobacco or paper remain.

Other details and aspects of the invention are more fully described in the examples set forth hereinafter.

EXAMPLE 1

This example illustrates the separation of the waste stream, i.e. ripper waste, from a cigarette manufacturing operation. The waste stream comprised, in major components, of tobacco, paper and filter tips (fibrous cellulose acetate). A total of 295 pounds of this waste was separated into its three major components. The final weight of each component stream is as follows: 66.5 pounds—tobacco; 65 pounds—paper; and 163.5 pounds—filter tips.

The separation was accomplished by means of air elutriation. A commercially available elutriator, Sterling Model 1608EL from Sterling Blower Company of Lynchburg, Va., was used. It was operated with air at 5000 feet per minute flow rate.

295 pounds of waste product was introduced into the elutriator for a first pass of separation. At the end of this pass, a mixture of 61 pounds—tobacco and 48 pounds—paper was removed from the remaining mass. The mixture of tobacco and paper was separated into its components by use of a conventional shaker screen device, as is well known.

The remaining mass was reintroduced into the elutriator for a second pass. At the end of this pass, a mixture of 5 pounds—tobacco and 10 pounds—paper was removed and further resolved into components by the shaker screen method noted above.

The remaining mass from the second pass was reintroduced into the elutriator for a third pass, At the end of this pass, a mixture of 0.5 pounds—tobacco and 7 pounds—paper was removed and separated as before. The remaining mass, which weighed 163.5 pounds, consisted primarily of filter tips, but included trace amounts of tobacco and paper as was apparent by visual inspection.

EXAMPLE 2

The waste product with tobacco and paper removed, for example in the manner set forth in Example 1, consisted substantially of filter tips from cigarettes. The tipping paper which surrounds the cellulose acetate filter media, and the contaminants contained in the cellulose acetate, were removed via a water washing technique.

The filter tip waste, prior to water washing, was analyzed to quantify contaminant levels. Using conventional gas chromatography techniques, the amount of plasticizer (glycerol triacetate) was measured at 7.59% by weight. Using industry acceptable techniques, the samples were observed to possess a strong tobacco odor and taste.

Water washing of cellulose acetate filter tips was accomplished by flowing water through a basket constructed of 316-stainless steel plate containing 0.125 inch circular perforations. Samples of 50–100 grams of filter tip waste were weighed and placed on the basket. Water 5–10 liters per minute, and heated to 65 degrees C., was flowed over the filters for 10–20 minutes. At the completion of the water washing, the cellulose acetate (now >99% free of paper, as measured by dissolution in acetone and gravimetric analysis) was oven dried at for 24 hours. After water washing, and drying, the samples, when analyzed, showed no trace of plasticizer (detection limit of the instrument was 0.0001%) and no trace of the odor nor the taste present in the feedstock.

EXAMPLE 3

The water washing/drying procedure set forth on Example 2 was repeated, except the wash water was heated to 95 degrees C. before flowing into the washing basket. After water washing and drying, the samples, when analyzed, showed no trace of plasticizer and no trace of the odor nor the taste present in the feedstock.

EXAMPLE 4

The washing/drying procedure set forth in Example 2 was repeated, substituting a steam autoclave for the washing basket. Filter waste tips (50 grams) where washed with 12 pound steam for 10 minutes. After washing and drying, the samples, when analyzed, showed no trace of plasticizer and no trace of the odor nor the taste present in the feedstock.

EXAMPLE 5

This example illustrates the use of a commercially available, industrial washer ("American Cascade" Model, American Laundry Machinery Co., of Cincinnati, Ohio). Samples of filter tip waste (5–10 pounds) were placed in a 0.187 inch mesh nylon mesh laundry bag, and subsequently washed with water in the washing machine. The range of conditions for the water washings are set forth on Table 1.

After washing and oven drying, the samples from washes 2–7 in Table 1 showed no trace of plasticizer and no trace of the odor nor the taste present in the feedstock. The sample obtained from wash 1, was relatively dark in color, and possessed a slight tobacco odor.

EXAMPLE 6

Cellulose acetate, reclaimed using the water washing process set forth in Example 5 (using wash conditions defined as washes 4–7 in Table 1) was combined with virgin cellulose acetate, dissolved in acetone to produce a 26.8% solution containing 80%/20% virgin:recycled cellulose acetate This solution was then filtered through a nominal 12 micron filter, and spun into a 2.0–3.5 denier per filament fiber on a dry spinning machine. From the resultant filament, cigarette filters were fashioned. Samples of the 80/20 virgin/recycle filters and of 100% virgin cellulose acetate filters were assembled with commercially available tobacco columns to produce cigarettes. These cigarettes were tasted for taste at Tragon Associates of Redwood City, Calif., an independent laboratory which conducts such taste testing on a routine basis. The taste panel testing found no statistically significant difference between cigarettes produced with 100% virgin cellulose acetate filters and those produced with 80%/20% virgin/recycled cellulose acetate.

EXAMPLE 7

Accelerated paper removal and whiter tips were observed when a peroxide solution pretreatment step was added to the process described in example 2. This improvement was accomplished by spraying a solution of 11.0–17.5% hydrogen peroxide mixed with water onto the filter tips at a 0.35 pounds of solution to 1 pound of tips while blending in a Marion Model #1001 horizontal mixer (available from Marion Mixer, Inc. of Marion, Iowa) for 20 to 40 minutes at 75 to 150 rpms. It was also discovered that water alone could achieve the same effect in paper removal but would require 2.66 pounds of water for every 1.0 pound of tips processed, however, the peroxide solution pretreated tips had a visually whiter appearance.

EXAMPLE 8

The waste product with tobacco and paper removed, for example in the manner set forth in Example 1, consisted substantially of filter tips from cigarettes. The tipping paper which surrounds the cellulose acetate filter media, and the contaminants contained in the cellulose acetate, were removed via a water washing technique at 50 lbs./hr. using a continuous process.

Water washing of the cellulose acetate filter tips was accomplished by following steps.

Step 1: The tips were pretreated using a tumbler and spray nozzle system designed by Hosakaw-Bepex Corp., Minneapolis, Minn., with a ratio of 2.66 lbs water/perioxide (7 parts $H_2O$/1 $H_2O_2$) to 1 lb. of cellulose acetate tips. Average residence time of the tips exposed to water in the tumbler was 30 minutes. The system is designed to breaks the coadhesion and hydrogen bonding of the paper prior to Step 2.

Step 2: The tips exit the tumbler onto a 1'×15' vibratory screener manufactured by Witte Mfg. Co. Water is sprayed on the tips via a spray nozzle system at 150–250 psi at a rate of 30 gpm though 8–30 degree straight spray high pressure nozzles. The water temperature on this system is 125 to 135 deg. F. The average residence time is 5 minutes. The purpose of this step is to flush the loose paper through the screen and allows the paper free tips to travel down the screen to Step 3.

Step 3: The tips exit the sprayer/screener and enter a hot water blanching step for chemical removal (triacetin, nicotine, menthol, etc.). The water flow is counter-current at 1.5 gpm with a temperature of 180 deg. F. to 210 deg. F.

Step 4: The tips are dewatered using a Hosakawa-Bepex V-press to 50–55% moisture.

Step 5: The tips are steamed using a blancher in which steam is injected. The average residence time is 6 minutes. The purpose of the steam injection in Steps 5 & 6 is to remove the tobacco odor.

Step 6: The tips are dried using a conventional apron dryer. Steam is injected while drying.

Step 7: The tips are reclaimed as set forth in example 6.

The present invention maybe embodied in other specific forms without departing from the spirit or essential attribute thereof and, accordingly, reference should be made to the appended claims, rather to the foregoing specification as indicating the scope of the invention.

TABLE 1

| Wash # | Batch Size, lbs. | # Wash Cycles | Cycle #/Temp. deg. F. | Cycle #/ Time, mins. | Batch/F low-thru | % Paper removal | color |
|---|---|---|---|---|---|---|---|
| 1 | 5 | 5X | 1/210 | 1/15 | 1/batch | 1/95 | yellow |
| | | | 2/130 | 2/10 | 2/batch | 2/99 | brown |
| | | | 3/130 | 3/10 | 3/flow | 3/100 | tint |
| | | | 4/130 | 4/10 | 4/flow | 4/100 | |
| | | | 5/180 | 5/10 | 5/batch | 5/100 | |
| 2 | 5 | 5X | 1/115 | 1/30 | 1/flow | 1/ND | slight |
| | | | 2/60 | 2/30 | 2/flow | 2/90 | yellow |
| | | | 3/130 | 3/30 | 3/batch | 3ND | |
| | | | 4/120 | 4/10 | 4/flow | 4/99.9 | |
| | | | 5/60 | 5/02 | 5/flow | 5/99.9 | |
| 3 | 5 | 7X | 1/130 | 1/10 | 1/batch | | slight |
| | | | 2/130 | 2/10 | 2/batch | | yellow |
| | | | 3/130 | 3/10 | 3/batch | | |
| | | | 4/130 | 4/10 | 4/batch | | |
| | | | 5/130 | 5/10 | 5/batch | | |
| | | | 6/110 | 6/10 | 6/flow | | |
| | | | 7/60 | 7/10 | 7/flow | 7/100 | |
| 4 | 5 | 5X | 1/60 | 1/15 | 1/flow | | white |
| | | | 2/80 | 2/10 | 2/batch | | |
| | | | 3/NA | 3/20 | 3/batch | | |
| | | | 4/130 | 4/30 | 4/batch | | |
| | | | 5/80 | 5/15 | 5/flow | 5/99.9 | |
| 5 | 10 | 5X | 1/60 | 1/15 | 1/flow | | white |
| | | | 2/130 | 2/15 | 2/batch | | slight |
| | | | 3/130 | 3/15 | 3/batch | | yellow |
| | | | 4/130 | 4/15 | 4/batch | | |
| | | | 5/90 | 5/15 | 5/flow | 5/99.9 | |
| 6 | 10 | 5X | 1/58 | 1/15 | 1/flow | 1/50 | white |
| | | | 2/110 | 2/15 | 2/batch | 2/60 | |
| | | | 3/58 | 3/15 | 3/flow | 3/70 | |
| | | | 4/120 | 4/15 | 4/batch | 5/97 | |
| | | | 5/58 | 5/10 | 5/flow | 5/99.9 | |
| 7 | 10 | 5x | 1/60 | 1/10 | 1/flow | 1/50 | white |
| | | | 2/120 | 2/10 | 2/batch | 2/60 | |
| | | | 3/60 | 3/10 | 3/flow | 3/70 | |
| | | | 4/120 | 4/15 | 4/batch | 4/97 | |
| | | | 5/60 | 5/10 | 5/flow | 5/99.9 | |

NC-not determined
NA-not available

We claim:

1. A process for recycling the waste from the manufacture of filtered cigarettes, said process comprising the steps of:

providing a waste stream from the manufacture of filtered cigarettes, the waste stream including tobacco, filter tips comprising cellulose ester polymer, and paper;

separating a substantial portion of the filter tips from the waste stream; and washing the filter tips with a sufficient volume of water to remove any paper bound to the filter tips and to remove any contaminants from the cellulose ester polymer, said water including an oxidizer.

2. The process according to claim 1 where in separating is by means of air elutriation.

3. The process according to claim 1 wherein during separating the tobacco content in the filter tips is reduced to less than about 1% by weight.

4. The process according to claim 1 further comprising the step of reducing the particle size of the waste stream.

5. The process according to claim 1 wherein a ratio of water to cellulose ester polymer is between about 0.85:1 and about 200:1.

6. The process according to claim 1 wherein said water is between about 10 and about 100 degrees C.

7. The process according to claim 1 wherein said water has a pH between about 4.0 to about 8.0.

8. The process according to claim 1 further comprising adding a surfactant, at less than 1.0% by weight, during washing.

9. The process according to claim 1 wherein said water is steam with an operating pressure of up to about 100 psig.

10. The process according to claim 1 wherein a portion of said water is between about 10 and about 100 degrees C., and a portion of the water is steam with an operating pressure of up to about 100 psig.

11. The process according to claim 1 further comprising the step of pretreating said filter tips after separation from said waste stream with an oxidizer.

12. A process for recycling filter tips from filtered cigarettes, said process comprising the steps of:

providing a waste stream of filter tips and paper, said filter tips comprising cellulose ester polymer;

pretreating said filter tips after separation from said waste stream with an oxidizer; and washing the filter tips with a sufficient volume of water to remove any paper bound to the filter tip and to remove any contaminants from the cellulose ester polymers.

* * * * *